US007871184B2

(12) United States Patent
Peng

(10) Patent No.: US 7,871,184 B2
(45) Date of Patent: Jan. 18, 2011

(54) HEAT DISSIPATING STRUCTURE AND LAMP HAVING THE SAME

(75) Inventor: Chang-Hung Peng, Chung-Ho (TW)

(73) Assignee: Cooler Master Co., Ltd, Taipei Hsien (TW)

( * ) Notice: Subject to any disclaimer, the term of this patent is extended or adjusted under 35 U.S.C. 154(b) by 248 days.

(21) Appl. No.: 12/122,878

(22) Filed: May 19, 2008

(65) Prior Publication Data

US 2009/0135613 A1 May 28, 2009

(30) Foreign Application Priority Data

Nov. 28, 2007 (TW) ..... 96220113 U

(51) Int. Cl.
*F21V 29/00* (2006.01)

(52) U.S. Cl. ..... 362/294; 362/373; 362/800; 361/703

(58) Field of Classification Search ..... 362/294, 362/345, 373, 249.01, 249.02, 480, 547; 313/45; 361/701–703, 697, 709, 710
See application file for complete search history.

(56) References Cited

U.S. PATENT DOCUMENTS

2004/0244948 A1* 12/2004 Luo ..... 165/80.3
2005/0111234 A1* 5/2005 Martin et al. ..... 362/555
2008/0175003 A1* 7/2008 Tsou et al. ..... 362/294
2009/0016063 A1* 1/2009 Hu ..... 362/294

FOREIGN PATENT DOCUMENTS

TW 285661 1/2006

* cited by examiner

*Primary Examiner*—Sandra L O Shea
*Assistant Examiner*—Leah S Lovell
(74) *Attorney, Agent, or Firm*—Chun-Ming Shih; HDLS IPR Services

(57) ABSTRACT

A heat dissipating structure includes a cover. The cover includes an inner heat dissipating body and an outer heat dissipating body. The inner heat dissipating body includes a cylinder and a plurality of first fins extending from an outer surface of the cylinder. The outer heat dissipating body includes a ring portion encircling a part of the inner heat dissipating body and a plurality of second fins extending from one side of the ring portion. In this way, more heat dissipating fins and larger heat dissipating surface area can be formed to enhance heat conduction and dissipation effect when restricted by the size of cover. A lamp with this heat dissipating structure is also provided. A service life of the LED in the lamp can be greatly prolonged.

33 Claims, 7 Drawing Sheets

HEAT DISSIPATING STRUCTURE AND LAMP HAVING THE SAME

BACKGROUND

The present invention relates to heat dissipating structures, and specifically to heat dissipating structures for projector lamps and lamps with the heat dissipating structures.

Light Emitting Diode (LED) has benefits of providing high illumination, low electrical consumption and long service life, which is widely used in illumination lamps. Since LED has poor heat resistance, and if a LED is not cooled for long time use, the service life of the LED will be seriously reduced. Therefore, it is an important issue in this art to provide a lamp and a heat dissipating structure thereof.

A conventional lamp and a heat dissipating structure thereof, as disclosed in Taiwan Patent No. M285661, includes a cover, a step-shaped circled portion formed on an outer surface of the cover and a mount of fins protruding from the circled portion. Heat can be transferred and dissipated therefrom through the circled portion and the fins thereof. The structure of this lamp is used for replacing a conventional projection lamp with the halogen lamp light source. If this lamp is used under the same working environment as the conventional lamp, the size of the lamp will be restricted by the original working environment.

The heat dissipating structure of the conventional lamp may be capable of transferring and dissipating heat from the LED. However, when the size of the lamp (e.g. projection lamp) is restricted by the working environment, it is very limited to enlarge the surface area for heat dissipating, and thereby the heat generated from the LED can not be sufficiently removed and dissipated. In addition, an effective heat dissipating surface area of the lamp which is composed with heat dissipating structure is difficult to extend outwardly, so that the heat generated from the LED can not be rapidly dissipated therefrom. In this way, a service life of the LED is greatly reduced.

BRIEF SUMMARY

The present invention relates to a heat dissipating structure. The heat dissipating structure includes an inner heat dissipating body cooperated with an outer heat dissipating body, thereby more heat dissipating fins and larger heat dissipating surface area can be formed to enhance heat conduction and dissipation effect when restricted by the size of cover.

The present invention relates to a heat dissipating structure. The heat dissipating structure includes a cover. The cover includes an inner heat dissipating body and an outer heat dissipating body. The inner heat dissipating body includes a cylinder and a plurality of first fins extending from an outer surface of the cylinder. The outer heat dissipating body includes a ring portion encircling a part of the inner heat dissipating body and a plurality of second fins extending from one side of the ring portion. One end of each second fin is connected to the cylinder.

The present invention relates to a lamp with a heat dissipating structure. By enhancing a heat dissipating surface area, heat generated from the LED or other light source can be rapidly dissipated therefrom, so that a service life of the LED can be greatly prolonged.

The present invention relates to a lamp with a heat dissipating structure. The lamp includes a cover, a plug module and an illumination module. The cover includes an inner heat dissipating body and an outer heat dissipating body. The inner heat dissipating body includes a cylinder and a plurality of first fins extending from an outer surface of the cylinder. The outer heat dissipating body includes a ring portion encircling a part of the inner heat dissipating body and a plurality of second fins extending from one side of the ring portion. One end of each second fin is connected to the cylinder. The plug module connects to one end of the cylinder. The illumination module connects to the other end of the cylinder. The illumination module is electrically connected to the plug module.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
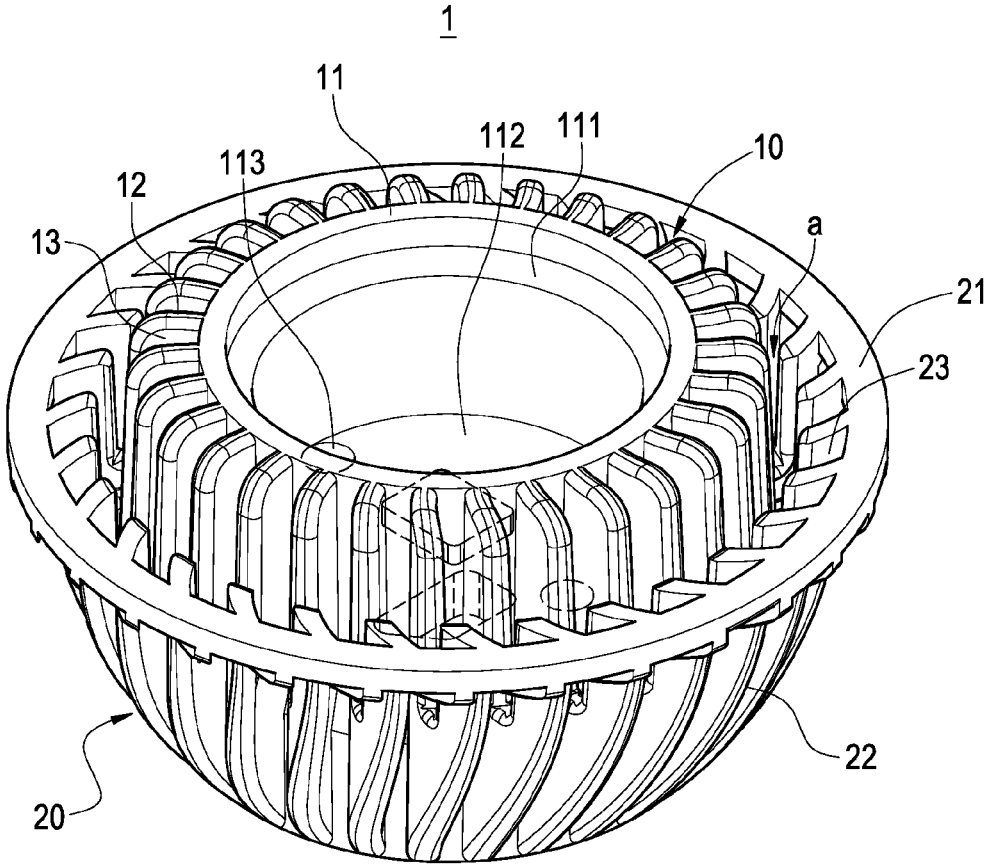
FIG. 1 is an isometric view of a heat dissipating structure of an exemplary embodiment of the present invention.
Figure 2:
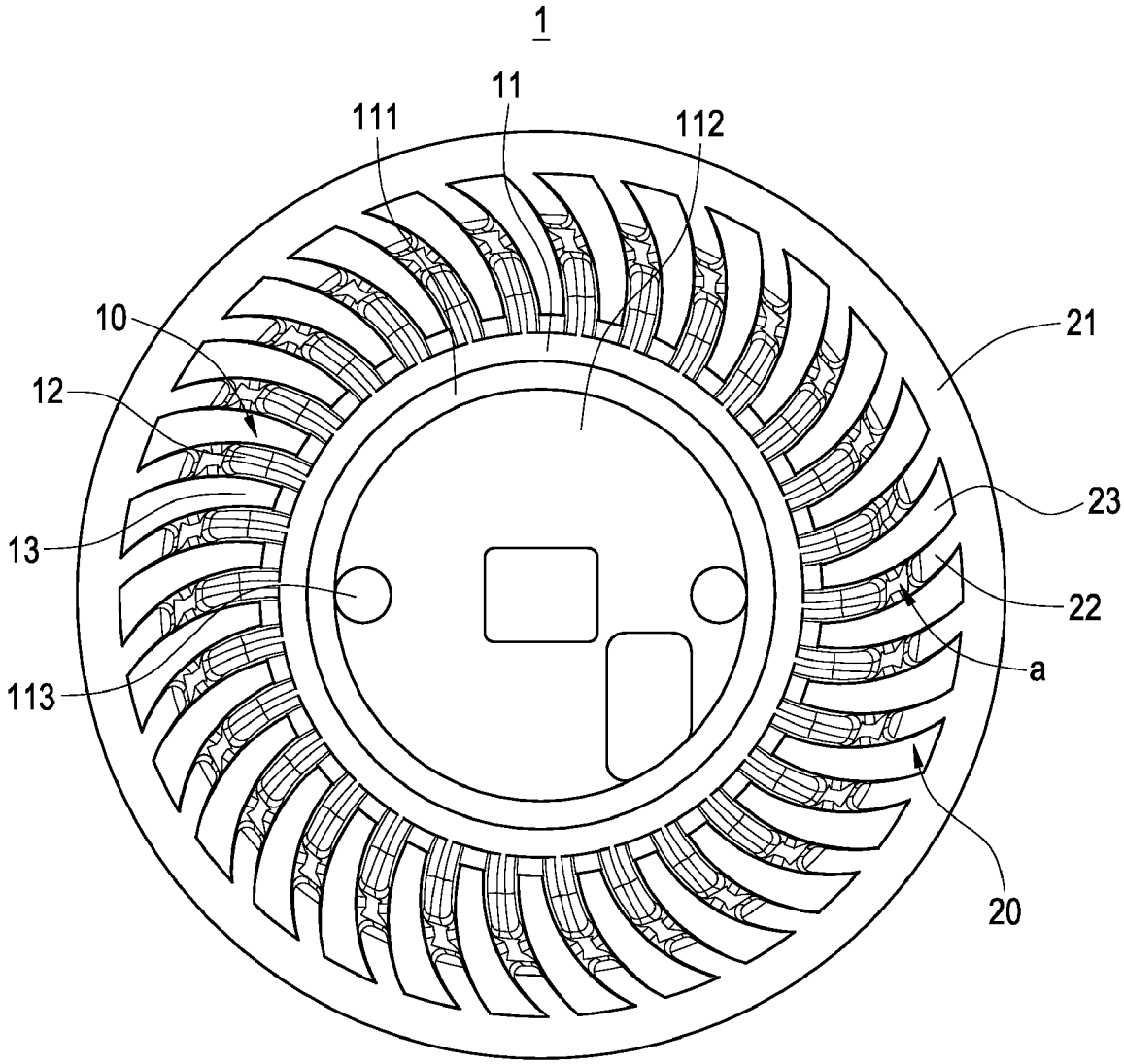
FIG. 2 is a top view of FIG. 1.

Referring to FIG. 1 and FIG. 2, an isometric view and a top view of an exemplary embodiment of the present invention are shown. A heat dissipating structure and a lamp with heat dissipating structure is provided in the present invention. The heat dissipating structure includes a cover 1. The cover 1 is made from a material with good thermal conduction such as aluminum. The cover 1 is an integrate constitution including an inner heat dissipating body 10 and an outer heat dissipating body 20. The inner heat dissipating body 10 has an upright cylinder 11 and a mount of first fins 12 radially extending from an outer surface of the cylinder 11. The cylinder 11 has a step-shaped opening 111 on a top portion thereof. A partition board 112 is fixed to a middle portion of the cylinder 11. A through hole 113 is defined in the partition board 112. Every two adjacent first fins 12 may have an equal interval or an unequal interval. In the exemplary embodiment of the present invention, the first fins 12 have an equal interval. A heat dissipating passage 13 is defined between every two adjacent first fins 12. Each first fin 12 may have a straight and laminated configuration or an arched and laminated configuration. In the exemplary embodiment of the present invention, each first fin 12 has an arched and laminated configuration. In the present application, the term laminated, in reference to the first fins 12, should be read to mean a layering. This layering is not restricted to forming a unitary piece. It is also not restricted to each layer touching an adjacent layer. In an embodiment of the invention as described in the figures, laminated is shown to be a layering of the first fins 12 when viewed along the circumferential plane, with each first fin 12 being separated by the heat dissipating passage 13.

The outer heat dissipating body 20 includes a ring portion 21 encircling a part of the inner heat dissipating body 10, and a mount of second fins 22 radially extending from an inner side of the ring portion 21. Every two adjacent second fins 22 may have an equal interval or an unequal interval. In the exemplary embodiment of the present invention, the second fins 22 have an equal interval. A bottom end of each second fin 22 is connected to an outer surface of a bottom portion of the cylinder 11. A heat dissipating passage 23 is defined between every two adjacent second fins 22. An interval passage "a" is defined between an inner surface of the second fins 22 and the outer surface of the first fins 12. The second fins 22 may be arranged aligned to the first fins 11 or arranged in staggered form with the first fins 12. In the exemplary embodiment of the present invention, the second fins 22 are arranged in staggered form with the first fins 11 (as shown in FIG. 2). Each second fin 22 may have a straight and laminated configuration or an arched and laminated configuration. In the exemplary embodiment of the present invention, each second fin 22 has an arched and laminated configuration. In the present application, the term laminated, in reference to the second fins 22, should be read to mean a layering. This layering is not restricted to forming a unitary piece. It is also not restricted to each layer touching an adjacent layer. In an embodiment of the invention as described in the figures, laminated is shown to be a layering of the second fins 22 when viewed along the circumferential plane, with each first fin 12 being separated by the heat dissipating passage 23.

Figure 3:
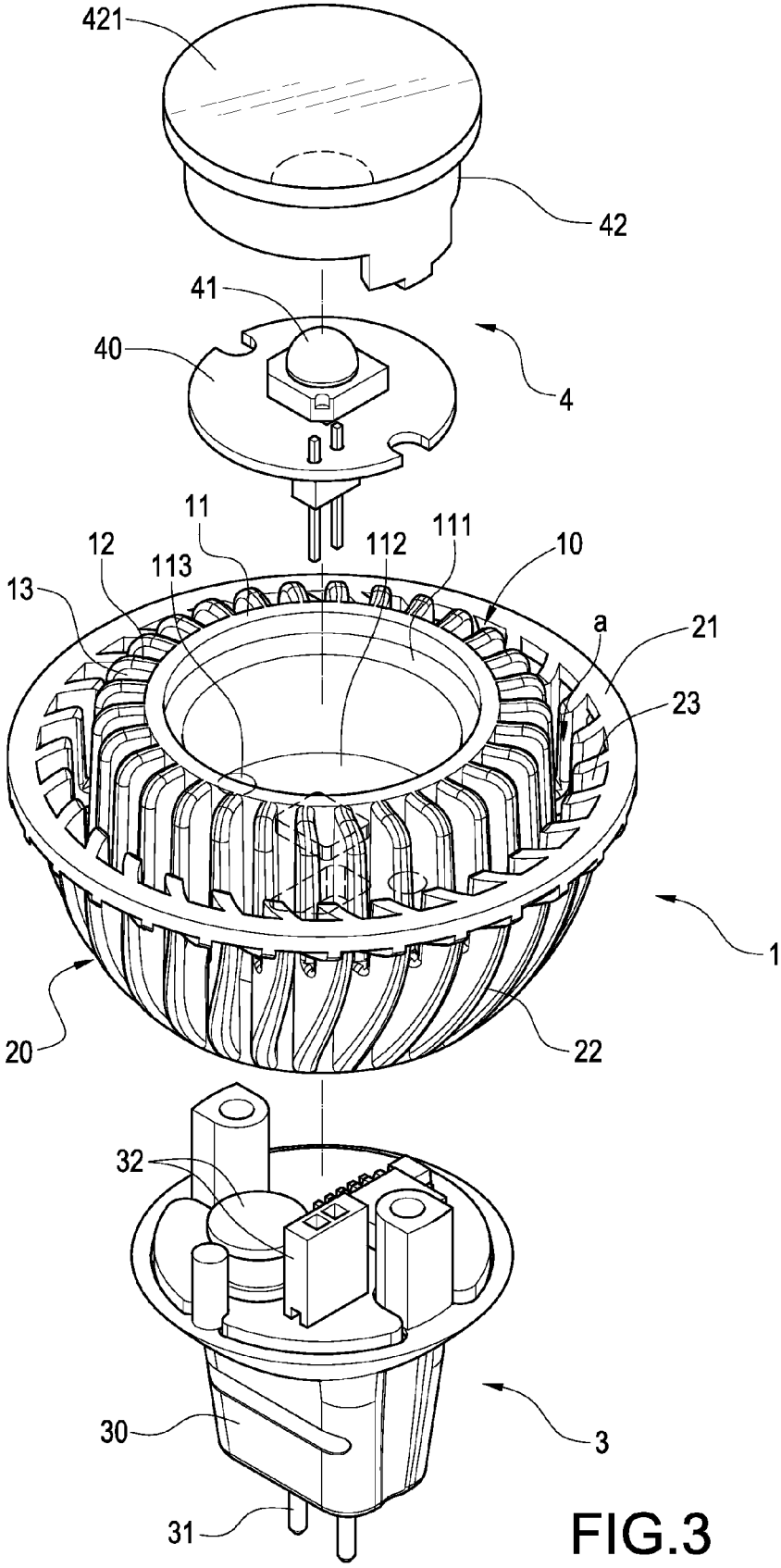
FIG. 3 is an exploded, isometric view of a lamp of the exemplary embodiment of the present invention.
Figure 4:
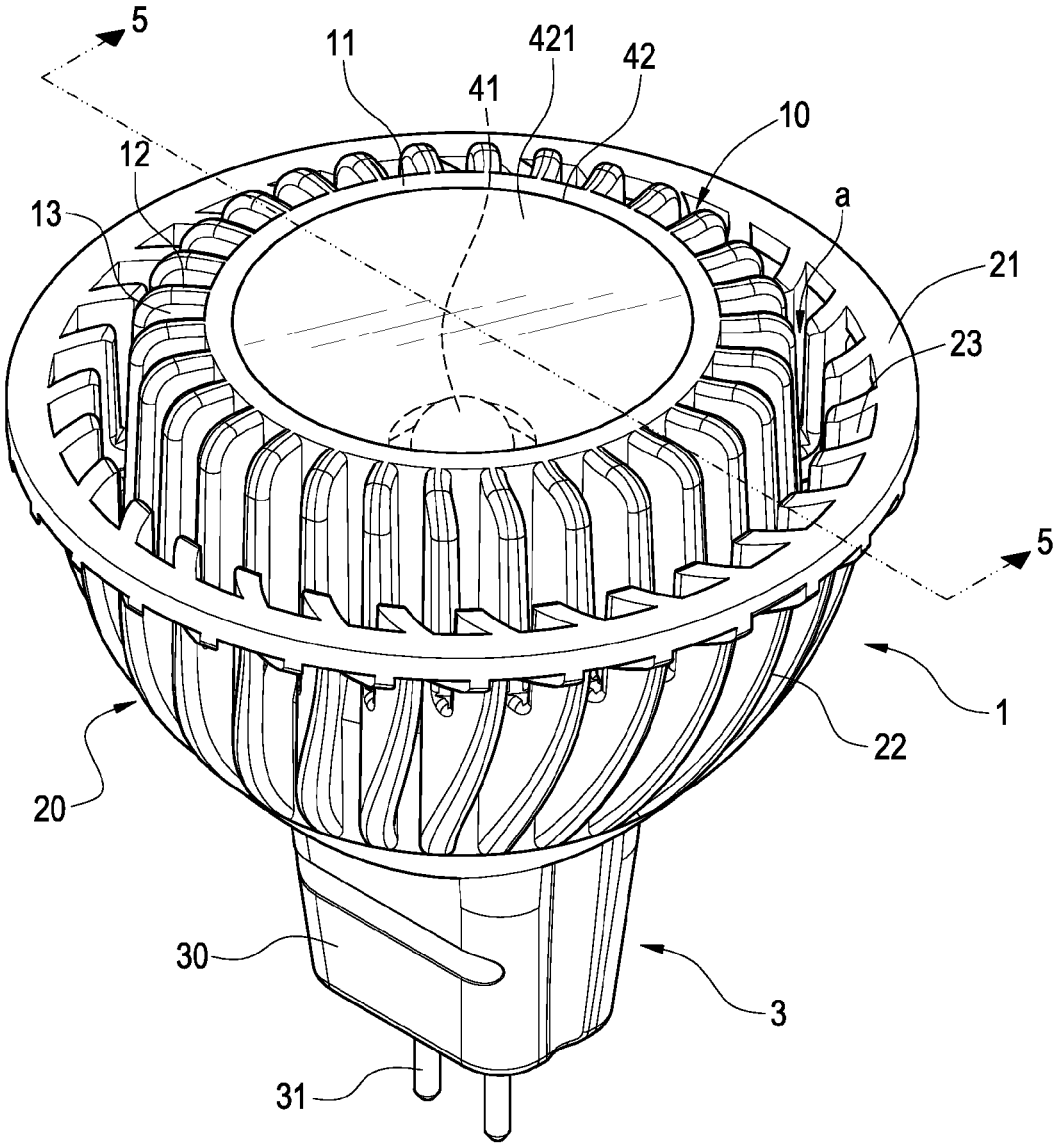
FIG. 4 is an assembled view of FIG. 3.

Referring also to FIG. 3 and FIG. 4, an exploded, isometric view and an assembled view of the lamp of the exemplary embodiment of the present invention are shown. An upper portion and a lower portion of the cover 1 may respectively receive a plug module 3 and an illumination module 4 for composing a lamp structure. The plug module 3 includes a base body 30, a pair of plug terminals 31 connecting to the base body 30 and a mount of electrical elements 32 (such as resistance, capacitance, connector and so on). The illumination module 4 includes an electrical board 40, a LED 41 connecting to the electrical board 40, and a reflecting shield 42 covering on the electrical board 40 and positioned corresponding to the LED 41. An electrically conductive terminal fixed on a bottom portion of the electrical board 40 is engaged with the connector of the plug module 3, thereby electrically connecting the plug module 3 to the illumination module 4. The LED 41 may be one or more. In the exemplary embodiment of the present invention, the one LED 41 is provided. A lens 421 is covered on a front distal surface of the reflection shield 42. The lamp of the exemplary embodiment of the present invention is composing by the connecting of the plug module 3, the illumination module 4 and the cover 1.

Figure 5:
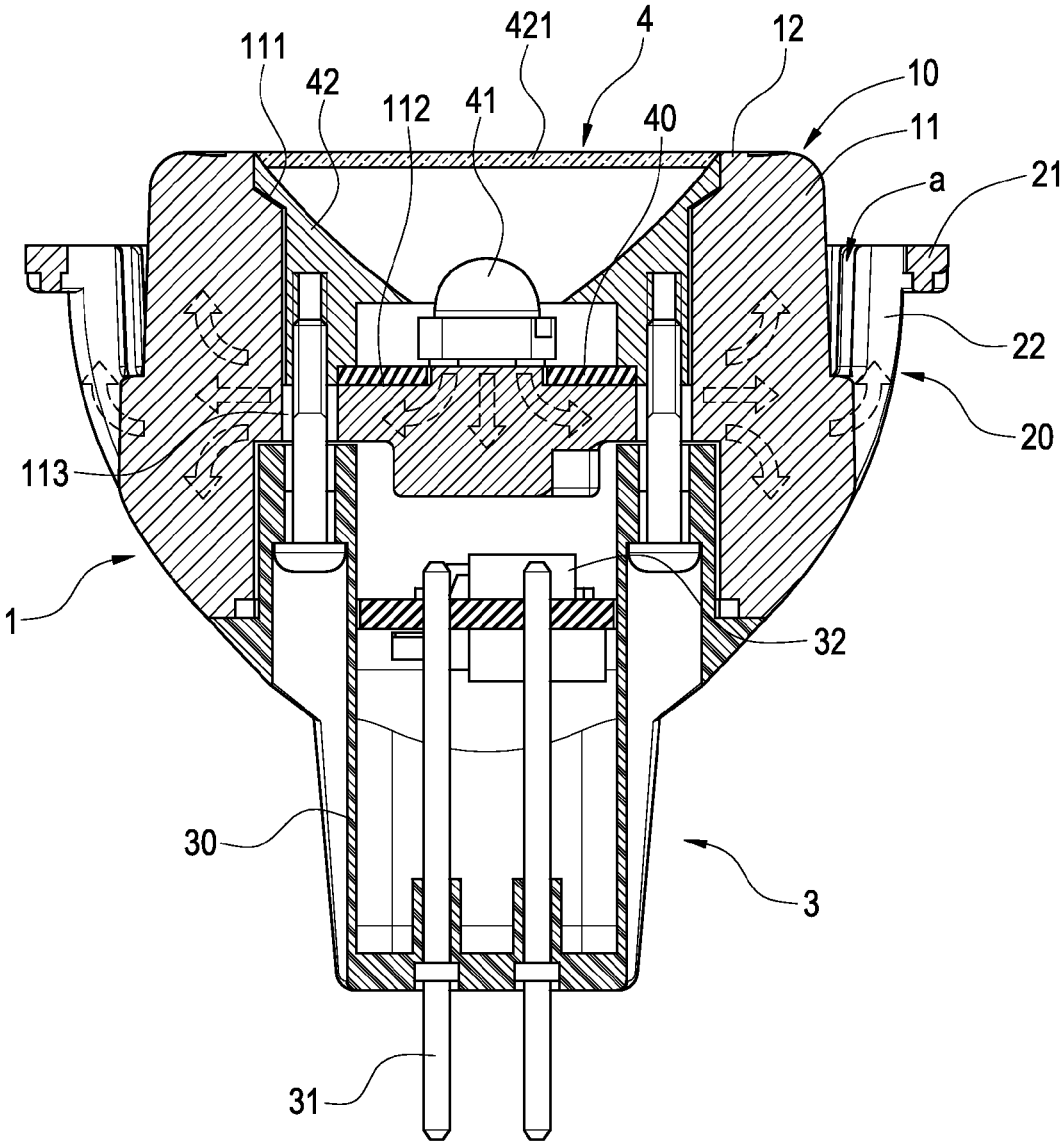
FIG. 5 is a sectional view along direction 5-5 of FIG. 4, when the lamp is in use.

Referring also to FIG. 5, a sectional view along a direction 5-5 of FIG. 4 is shown. When using the lamp, the plug terminals 31 are plugged in a socket (not shown), the LED 42 illuminates by electrically connected to the power through the connecter. The LED 42 generates heat therefrom. The heat is first conducted to the partition board 112, and then the heat is conducted to the first fins 11 and the second fins 22. In this way, the heat is dissipated from the first fins 11 and the second fins 22 out of the cover 1 by natural air convection effect.

Figure 6:
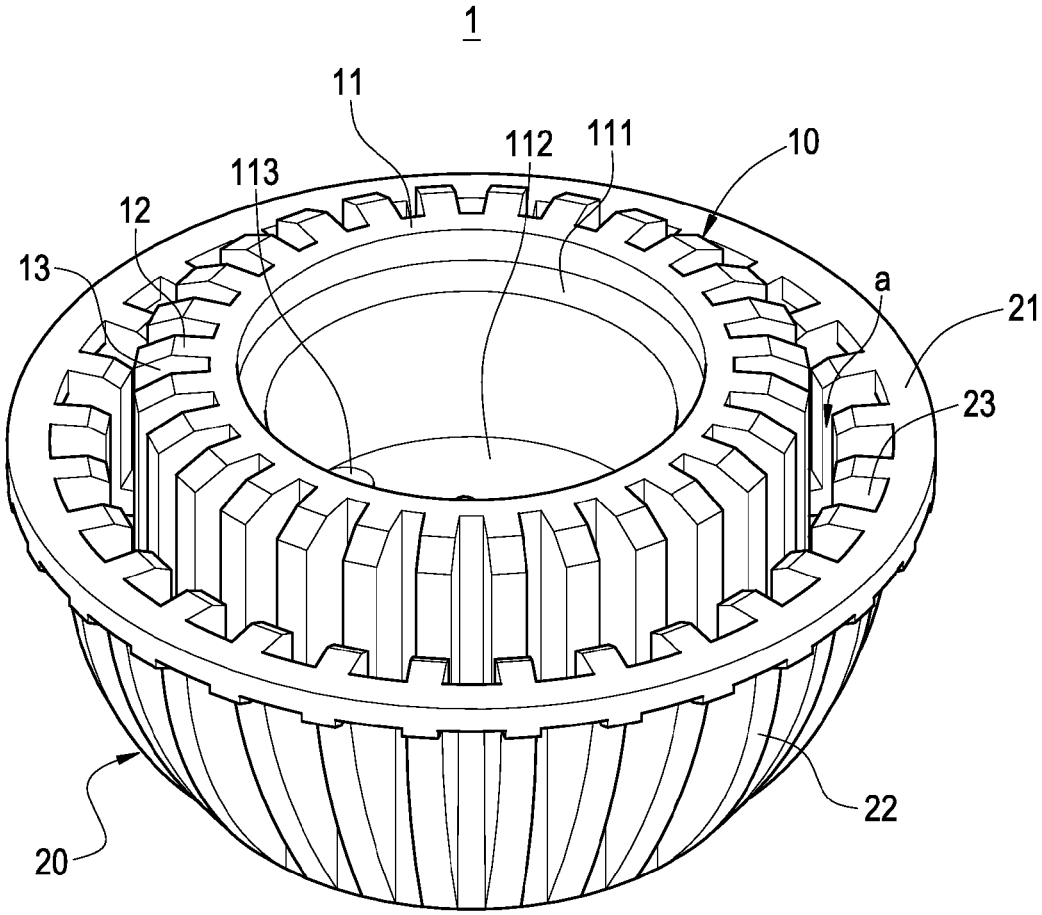
FIG. 6 is an isometric view of a heat dissipating structure of another exemplary embodiment of the present invention.
Figure 7:
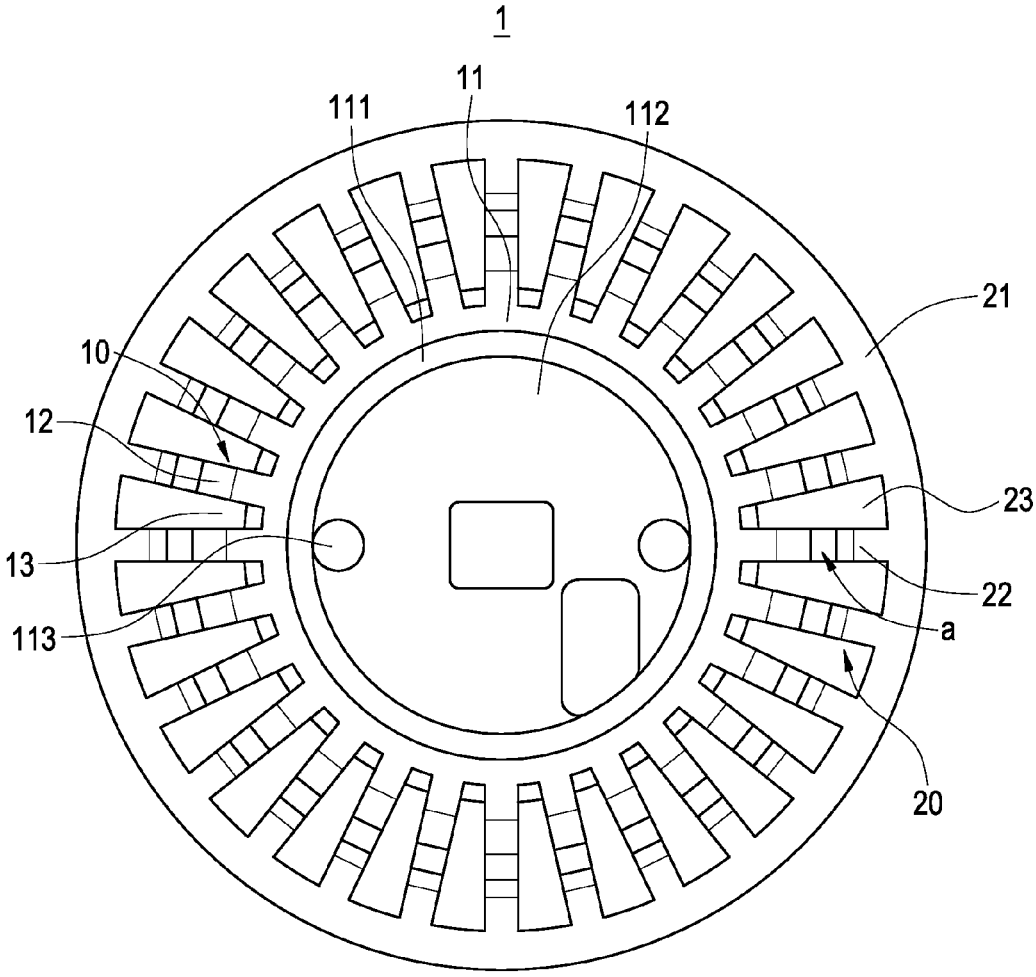
FIG. 7 is a top view of FIG. 6.

Referring also to FIG. 6 and FIG. 7, an isometric view and top view of another exemplary embodiment of the present invention is shown. The cover 1 may have an alternative structure as shown. The first fins 12 extend straightly from the outer surface of the cylinder 11. The second fins 22 also extend straightly from the inner surface of the ring portion 21. Each first fin 12 is aligned with a corresponding second fin 22. Same heat dissipating effect of the heat dissipation structure will be achieved compared with the heat dissipation structure in former embodiment of the present invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A heat dissipating structure for a light emitting element, comprising:

a cover comprising:

an inner heat dissipating body comprising an cylinder and a plurality of first fins extending from an outer surface of the cylinder; and an outer heat dissipating body comprising a ring portion encircling a part of the inner heat dissipating body and a plurality of second fins, wherein one end of the plurality of second fins is connected to a portion of the cylinder and another end of the plurality of second fins is connected to one side of the ring portion.

2. The heat dissipating structure for a light emitting element as claimed in claim 1, wherein the outer heat dissipating body is integrally formed on the inner heat dissipating body.

3. The heat dissipating structure for a light emitting element as claimed in claim 1, wherein a step-shaped opening is defined on a top portion of the cylinder, a partition board is fixed to a middle portion of the cylinder, and a plurality of through holes is defined in the partition board.

4. The heat dissipating structure for a light emitting element as claimed in claim 1, wherein every two adjacent of the plurality of first fins have an equal interval, and a heat dissipating passage is defined between every two adjacent of the plurality of first fins.

5. The heat dissipating structure for a light emitting element as claimed in claim 1, wherein every two adjacent of the plurality of first fins have an unequal interval, and a heat dissipating passage is defined between every two adjacent of the plurality of first fins.

6. The heat dissipating structure for a light emitting element as claimed in claim 1, wherein each of the plurality of first fins has a straight configuration.

7. The heat dissipating structure for a light emitting element as claimed in claim 1, wherein each of the plurality of first fin has an arched configuration.

8. The heat dissipating structure for a light emitting element as claimed in claim 1, wherein one end of each of the plurality of second fins is connected to an outer surface of a bottom portion of the cylinder.

9. The heat dissipating structure for a light emitting element as claimed in claim 1, wherein every two adjacent of the plurality of second fins have an equal interval, and a heat dissipating passage is defined between every two of the plurality of adjacent second fins.

10. The heat dissipating structure for a light emitting element as claimed in claim 1, wherein every two adjacent of the plurality of second fins have an unequal interval, and a heat dissipating passage is defined between every two adjacent of the plurality of second fins.

11. The heat dissipating structure for a light emitting element as claimed in claim 1, wherein an interval passage is defined between an inner surface of the second fins and an outer surface of the first fins.

12. The heat dissipating structure for a light emitting element as claimed in claim 1, wherein the second fins are arranged aligned to the first fins.

13. The heat dissipating structure for a light emitting element as claimed in claim 1, wherein the second fins are arranged in staggered form with the first fins.

14. The heat dissipating structure for a light emitting element as claimed in claim 1, wherein each outer surface second fins has a straight configuration.

15. The heat dissipating structure for a light emitting element as claimed in claim 1, wherein each outer surface second fins has an arched configuration.

16. A lamp with a heat dissipating structure comprising:

a cover comprising:

an inner heat dissipating body comprising an cylinder and a plurality of first fins extending from an outer surface of the cylinder; and an outer heat dissipating body comprising a ring portion encircling a part of the inner heat dissipating body and a plurality of second fins, wherein one end of the plurality of second fins is connected to a portion of the cylinder and another end of the plurality of second fins is connected to one side of the ring portion;

a plug module connecting to one end of the cylinder; and an illumination module connecting to the other end of the cylinder, and the illumination module being electrically connected to the plug module.

17. The lamp as claimed in claim 16, wherein the outer heat dissipating body is integrally formed on the inner heat dissipating body.

18. The lamp as claimed in claim 16, wherein a step-shaped opening is defined on a top portion of the cylinder, a partition board is fixed to a middle portion of the cylinder, and a plurality of through holes is defined in the partition board.

19. The lamp as claimed in claim 16, wherein every two adjacent of the plurality of first fins have an equal interval, and a heat dissipating passage is defined between every two adjacent of the plurality of first fins.

20. The lamp as claimed in claim 16, wherein every two adjacent of the plurality of first fins have an unequal interval, and a heat dissipating passage is defined between every two adjacent of the plurality of first fins.

21. The lamp as claimed in claim 16, wherein each of the plurality of first fin has a straight configuration.

22. The lamp as claimed in claim 16, wherein each of the plurality of first fin has an arched configuration.

23. The lamp as claimed in claim 16, wherein one end of each of the plurality of second fin is connected to the outer surface of a bottom portion of the cylinder.

24. The lamp as claimed in claim 16, wherein every two adjacent of the plurality of second fins have an equal interval, and a heat dissipating passage is defined between every two adjacent of the plurality of second fins.

25. The lamp as claimed in claim 16, wherein every two adjacent of the plurality of second fins have an unequal interval, and a heat dissipating passage is defined between every two adjacent of the plurality of second fins.

26. The lamp as claimed in claim 16, wherein an interval passage is defined between an inner surface of the second fins and the outer surface of the first fins.

27. The lamp as claimed in claim 16, wherein the second fins are arranged aligned to the first fins.

28. The lamp as claimed in claim 16, wherein the second fins are arranged in staggered form with the first fins.

29. The lamp as claimed in claim 16, wherein each of the plurality of second fins has a straight configuration.

30. The lamp as claimed in claim 16, wherein each of the plurality of second fins has an arched configuration.

31. The lamp as claimed in claim 16, wherein the plug module comprises a base body connected to the cylinder, and a pair of plug terminals arranged on the base body and extending outside the base body.

32. The lamp as claimed in claim 16, wherein the illumination module comprises an electrical board fixed in the cylinder, at least one LED connecting to the electrical board, and a reflecting shield covering on the electrical board and positioned corresponding to the at least one LED.

33. The lamp as claimed in claim 32, wherein a lens is covered on a distal surface of the reflection shield.

* * * * *